US005462491A

United States Patent [19]

MacDonald

[11] Patent Number: 5,462,491

[45] Date of Patent: Oct. 31, 1995

[54] BOWLING BALL WITH WEIGHT BLOCK

[75] Inventor: Wayne D. MacDonald, San Antonio, Tex.

[73] Assignee: Columbia Industries, Inc., San Antonio, Tex.

[21] Appl. No.: 302,387

[22] Filed: Sep. 8, 1994

Related U.S. Application Data

[63] Continuation of Ser. No. 183,141, Jan. 18, 1994, abandoned.

[51] Int. Cl.[6] ..... A63B 37/06

[52] U.S. Cl. ..... 473/126; 273/DIG. 20

[58] Field of Search ..... 473/126; 273/DIG. 20, 273/230

[56] References Cited

U.S. PATENT DOCUMENTS

| | | | |
|---|---|---|---|
| 3,865,369 | 2/1975 | Randolph | 273/63 E |
| 4,121,828 | 10/1978 | Amburgey | 273/63 E |
| 4,264,071 | 4/1981 | Randolph | 273/63 E |
| 4,320,899 | 3/1982 | Salvino | 273/63 E |
| 4,592,551 | 6/1986 | Lee | 283/63 E |
| 5,037,096 | 8/1991 | Pinel, Jr. et al. | 273/63 E |
| 5,046,731 | 9/1991 | Zelinski | 273/63 E |
| 5,074,553 | 12/1991 | Pawlowski et al. | 273/63 E |
| 5,125,656 | 6/1992 | Fabanich | 273/63 E |
| 5,149,089 | 9/1992 | Zelinski | 273/63 E |
| 5,215,304 | 6/1993 | Pinel, Jr. et al. | 273/63 E |
| 5,238,245 | 8/1993 | Sposato | 273/63 E |

*Primary Examiner*—William M. Pierce

*Attorney, Agent, or Firm*—Donald R. Commuzi; Christopher L. Makay

[57] ABSTRACT

A bowling ball comprises a core surrounded by a cover stock. The core comprises a body with its center positioned substantially coincident with the bowling ball's geometric center and a weight block positioned as close to the outer surface of the bowling ball as possible. The weight block functions as a top weight to offset the mass lost in the bowling ball due to the drilling of gripping holes and balance holes. Furthermore, the weight block provides the three ounce out of balance maximum between the top and bottom of the bowling ball to produce a gyroscopic steering effect which creates a sharp break in the path of the bowling ball at the back end of the bowling lane. The body of the core lowers the moment inertia of the bowling ball to produce a ball with stable rolling characteristics.

6 Claims, 2 Drawing Sheets

BOWLING BALL WITH WEIGHT BLOCK

CROSS-REFERENCE TO RELATED APPLICATIONS

This application is a continuation application of Ser. No. 08/183,141 filed on Jan. 18, 1994, now abandoned.

BACKGROUND OF THE INVENTION

1. Field of the Invention

The present invention relates to bowling balls and, more particularly, but not by way of limitation, to a bowling ball having a core with an improved weight block which optimizes the gyroscopic steer of the ball to produce a breakpoint at the back end of the bowling lane.

2. Description of the Related Art

The design of bowling balls typically incorporates one or more weight blocks which compensate for the weight removed by the drilling of gripping and balance holes. These weight blocks are traditionally placed in the "top" of the bowling ball to provide dynamic balance to the bowling ball as it rolls down the bowling lane. Furthermore, weight blocks are incorporated because the manipulation of both their shape and position within the bowling ball will produce a higher degree of hooking in the bowling ball without violating the rules which govern the balance of bowling balls promulgated by the American Bowling Congress.

U.S. Pat. No. 4,121,828 issued on Oct. 24, 1978 to Amburgay discloses one such top weight design. Amburgay discloses top weights shaped in various forms such as spheres, annular disks, or two spherical portions formed integrally with and connected together by a bridge. One of these top weights is placed in the bowling ball to offset the weight loss resulting from the forming of gripping holes. Additionally, the top weight produces a gyroscopic stabilizing effect to enhance the hooking of the ball.

U.S. Pat. No. 5,046,731 issued on Sep. 10, 1991 to Zelinski discloses another weight block design. Zelinski discloses a T-shaped weight block wedged within the inner core of the bowling ball. A portion of the T-shaped weight block protrudes from the core to offset the weight removed from the bowling ball during the drilling of the gripping holes. Furthermore, similar to Amburgay, the weight block of Zelinski improves the hooking characteristics of the bowling ball.

SUMMARY OF THE INVENTION

In accordance with the present invention, a bowling ball comprises a core with an improved weight block surrounded by a coverstock. The core includes a body formed from a spherical portion which terminates at one end in a frustroconical base. The body of the core is positioned within the bowling ball such that its geometrical center is substantially coincident to the geometrical center of the bowling ball.

The core further includes a weight block connected at the end of the spherical portion opposite from the base. The weight block resides as close to the outer surface of the bowling ball as possible while still maintaining the structural integrity of the bowling ball. That is, sufficient coverstock material resides between the weight block and the outer surface of the bowling ball to prevent the coverstock from cracking during use.

The weight block furnishes the bowling ball with top weight which replaces mass in the bowling ball removed due to the drilling of holes for gripping purposes or balance holes drilled to adjust the static weight of the bowling ball. Furthermore, the weight block provides the maximum allowable three ounce out of balance between the top and bottom of the bowling ball permitted by the American Bowling Congress. The positioning of the weight block to provide the three ounce out of balance optimizes the gyroscopic steer of the bowling ball to produce a bowling ball that breaks sharply at the back end of the bowling lane.

More particularly, as the bowling ball travels down the bowling lane, the rotation imparted by the bowler to the bowling ball attempts to force a quick break in the path of the bowling ball. However, the weight block produces a gyroscopic effect to provide an initial counterbalancing force which holds the ball along its original path of travel. However, as with any gyroscopic effect, the initial counter balancing force created by the weight block reverses to add with the rotation imparted to the bowling ball by the bowler. Consequently, the bowling ball breaks sharply to produce a hook in its path of travel. Thus, by initially resisting the rotational forces imparted to the ball by the bowler, the weight block produces a large hook at the back end of the bowling lane. That hooking of the bowling ball at the back end of the bowling lane is extremely desirable because it permits maximum ball control while increasing the kinetic energy of the ball.

Although a large weight block is desirable because it creates a lope in the spinning action of the bowling ball to produce the gyroscopic effect described above, a weight block that generates excessive loping will cause the bowling ball to wobble as it rolls down the lane. A bowling ball that wobbles excessively is extremely difficult to control, thereby making it difficult to score well. Thus, the bowling ball includes the body, which is constructed from a dense material, to ensure the bowling ball exhibits stable rolling characteristics. The dense body lowers the moment of inertia of the bowling ball to prevent the weight block from producing an excessive lope in the spin of the bowling ball as it travels down the bowling lane. Consequently, the bowling ball does lope to produce enhanced gyroscopic steering, however, it also rolls down the bowling lane without any undesirable wobble to produce an extremely stable bowling ball.

It is, therefore, an object of the present invention to produce a bowling ball with a core having an improved weight block portion which enhances the hooking pattern of the bowling ball.

It is another object of the present invention to provide a bowling ball with a core including a body that prohibits creating excessive loping in the spin of the bowling ball as it travels down the bowling lane.

It is a further object of the present invention to provide a bowling ball having a weight block which optimizes the three ounce out of balance of the bowling ball to provide a gyroscopic steer that produces a sharp break in the bowling ball at the back end of the bowling lane.

It is still another object of the present invention to provide a two piece bowling ball for ease of manufacture.

It is still a further object of the present invention to provide a bowling ball with a core having a body which stabilizes the rolling pattern of the ball.

Still other objects, features, and advantages of the present invention will become evident to those skilled in the art in light of the following.

DETAILED DESCRIPTION OF THE PREFERRED EMBODIMENT

Figure 1:
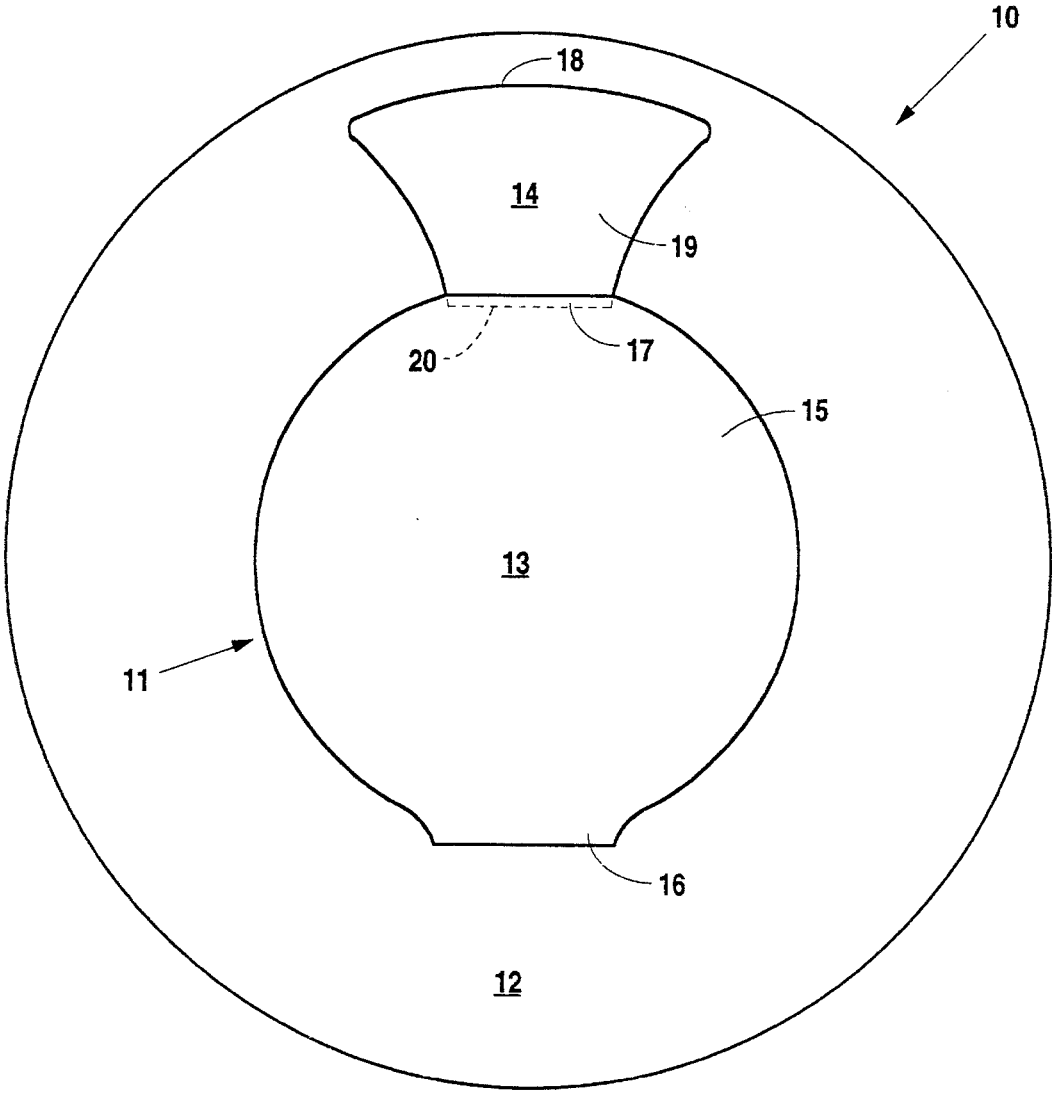
FIG. 1 is a cross section depicting the core and coverstock of the bowling ball according to the present invention.
Figure 2:
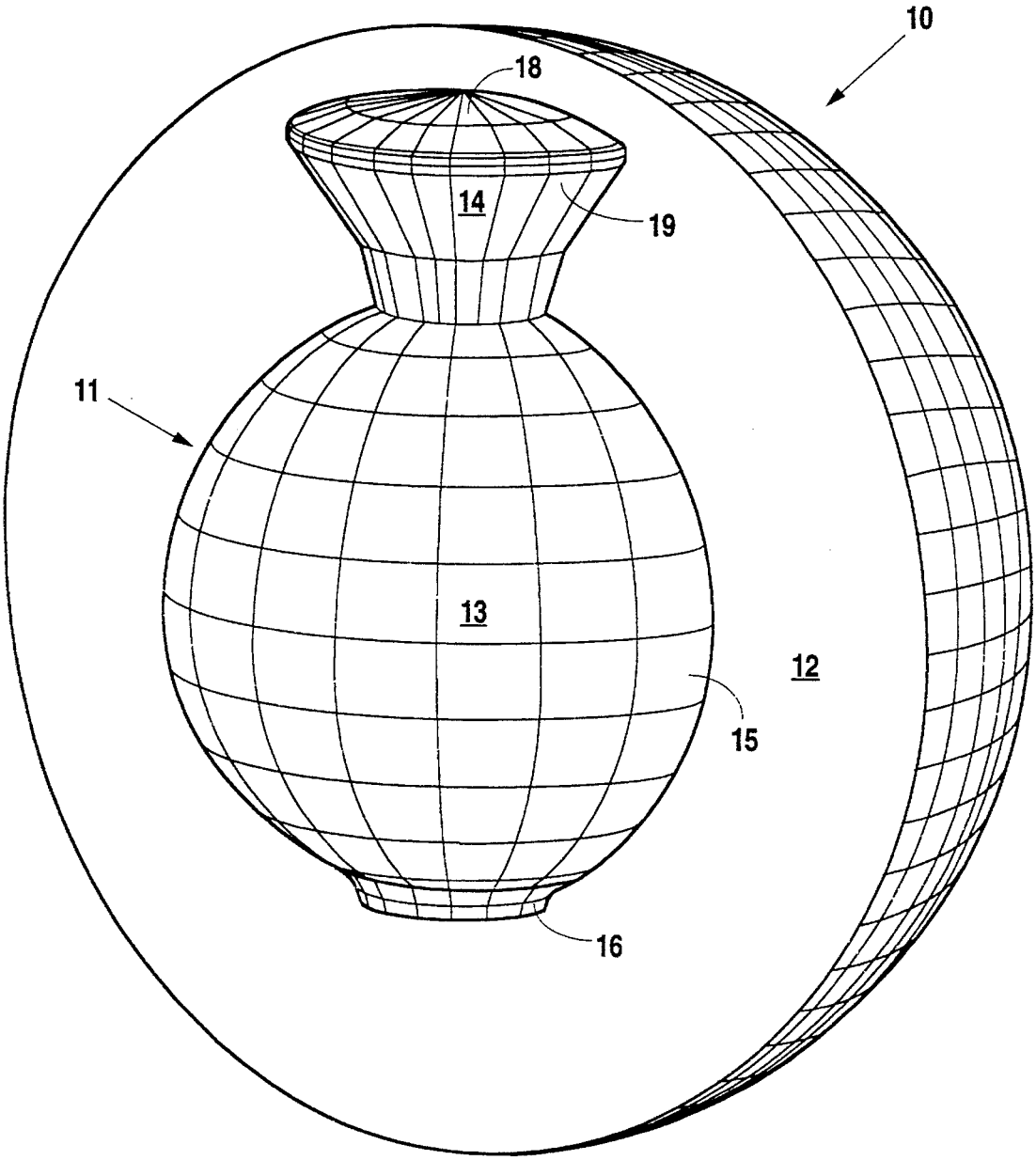
FIG. 2 is a perspective view depicting the core and coverstock of the bowling ball according to the present invention.

As illustrated in the FIGS., bowling ball 10 comprises core 11 and coverstock 12. Core 11 comprises body 13 and weight block 14. Body 13 comprises spherical portion 15 which terminates at one end in frustro-conical base 16. Spherical portion 15 includes cavity 17 formed at the end of spherical portion 15 opposite from base 16. Body 13 resides within bowling ball 10 such that its geometric center is positioned substantially coincident with the geometric center of bowling ball 10. Body 13 is formed using any standard molding process and comprises a binding material such a polyester which may be combined with a high density filler such a barium sulfite to produce a dense inner core.

Weight block 14 comprises top portion 18 formed integrally with bottom portion 19. Top portion 18 comprises a truncated spherical member the curve of which approximates the curve of the outer surface of bowling ball 10. Bottom portion 19 comprises a substantially frustro-conical member that includes circular surface 20 at one end which expands to meet top portion 18 along a curve surface produced by a non-linearly changing diameter. Thus, bottom portion 19 has a non-linearly changing horizontal cross-section due to the curves surface connecting top portion 18 and circular surface 20. Weight block 14 is fashioned using any standard molding process and comprises a binding material such as polyester which may be combined with a high density filler such as barium sulfite to produce a dense top weight within bowling ball 10.

Core 11 is formed by securing weight block 14 within cavity 17 using any suitable means such as an adhesive. Weight block 14 is positioned as close to the outer surface of bowling ball 10 as possible while still maintaining the structural integrity of bowling ball 10. That is, a sufficient amount of coverstock 12 material resides between weight block 14 and the outer surface of bowling ball 10 to prevent coverstock 12 from cracking during use. Weight block 14 furnishes bowling ball 10 with top weight which replaces mass in bowling ball 10 removed due to the drilling of holes for gripping purposes or balance holes to adjust the static weight.

Furthermore, the positioning of weight block 14 near the outer surface of bowling ball 10 optimizes the three ounce out of balance of bowling ball 10. By optimizing the three ounce out of balance of bowling ball 10, weight block 14 optimizes the gyroscopic steer of bowling ball 10 to produce a sharp break point at the back end of the bowling lane. Weight block 14 provides a counterweight which initially compensates for the rotation imparted to bowling ball 10 by a bowler. As bowling ball 10 travels down the bowling lane, the rotation imparted by the bowler attempts to force bowling ball 10 to break. However, weight block 14 produces a gyroscopic effect to furnish an initial counterbalancing force which holds bowling ball 10 along its original path of travel. However, as with any gyroscopic effect, the initial counterbalancing force created by weight block 14 reverses to add with the rotation imparted to bowling ball 10 by the bowler. Consequently, bowling ball 10 breaks sharply to produce a hook in its path of travel. The hooking of bowling ball 10 at the back end of the bowling lane is extremely desirable because it permits maximum ball control while still increasing the kinetic energy of bowling ball 10.

Although weight block 14 is desirable because it creates a lope (i.e., flair) in the spinning action of bowling ball 10 to produce the gyroscopic effect described above, it must not generate excessive loping or bowling ball 10 will wobble as it rolls down the lane. If bowling ball 10 wobbled excessively as it travelled down the bowling lane, it would be extremely difficult to control, thereby making it difficult to score well. Thus, bowling ball 10 includes body 13, which is constructed from a dense material, to ensure bowling ball 10 exhibits stable rolling characteristics. The denseness of body 13 lowers the moment of inertia of bowling ball 10 to prevent weight block 14 from producing an excessive lope in the spin of bowling ball 10 as it travels down the bowling lane. Consequently, the bowling ball 10 does lope to produce enhanced gyroscopic steering, however, it also rolls down the bowling lane without any undesirable wobble to produce an extremely stable bowling ball.

Coverstock 12 is comprised of any standard coverstock material presently used to form bowling ball coverstock such as polyurethane. Additionally, the outer surface of coverstock 12 is finished to meet the bowling ball diameter requirements promulgated by the American Bowling Congress.

To construct bowling ball 10, a two section split mold having an inner surface shaped to mirror the shape of body 13 is filled with the binding material described above with reference to body 13. Similarly, a two section split mold having an inner surface shaped to mirror the shape of weight block 14 is filled with the binding material described above with reference to weight block 14. After body 13 and weight block 14 have hardened, they are removed from their respective molds. Weight block 14 is then inserted into cavity 17 of body 13 and secured using any suitable adhesive.

Weight block 14 is typically molded with a hole in its top to allow core 11 to be supported by a support pin within the spherical cavity of a two section split mold utilized to form coverstock 12. Alternatively, after core 11 is formed, a hole may be drilled in the top of weight block 14 to allow core 11 to be supported by a support pin within the spherical cavity of the two section split mold utilized to form coverstock 12. The mold utilized to form coverstock 12 is a standard mold which creates the spherical shape of coverstock 12. After core 11 has been supported within the mold, the coverstock material described above is poured into the mold about core 11. Once the coverstock material has hardened, bowling ball 10 is removed from the mold for finishing.

The finishing of bowling ball 10 consists of first filling with coverstock material the hole produced in bowling ball 10 due to the drilling of core 11 and the pin of the coverstock mold which resided within the hole in core 11. After the hole is filled, coverstock 12 of bowling ball 10 is machined to meet the diameter requirements promulgated by the American Bowling Congress. Once bowling ball 10 is the correct diameter, it is sanded smooth to produce a final finished bowling ball ready for use.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is to be defined only by the claims which follow.

We claim:

1. A bowling ball, comprising:

a substantially spherical core body;

a weight block having a non-linearly changing diameter connected to said core body, said weight block formed integrally in the shape of a truncated spherical member and a substantially frustro-conical member; and a coverstock surrounding said substantially spherical core body and said weight block.

2. The bowling ball according to claim 1 wherein said substantially spherical core body resides within said bowling ball such that its geometric center is positioned substantially coincident to the geometric center of said bowling ball.

3. The bowling ball according to claim 1 wherein said substantially spherical core body comprises a sphere which terminates at the end opposite from said weight block in a frustro-conical base.

4. The bowling ball according to claim 1 wherein said weight block resides as close to the outer surface of said bowling ball as possible while still maintaining the structural integrity of said coverstock.

5. The bowling ball according to claim 1 wherein the curved surface of said truncated spherical member approximates the curve of the outer surface of said bowling ball.

6. The bowling ball according to claim 1 wherein said weight block is adhesively secured to said core body.

* * * * *